US007255254B2

(12) United States Patent
Tan

(10) Patent No.: US 7,255,254 B2
(45) Date of Patent: Aug. 14, 2007

(54) DISPENSER APPARATUS AND METHOD FOR A CONTINUOUS ROLL OF PLASTIC BAG MATERIAL

(75) Inventor: Hin Siang Michael Tan, San Ramon, CA (US)

(73) Assignee: Pan Pacific Plastics Manufacturing, Inc., Hayward, CA (US)

( * ) Notice: Subject to any disclaimer, the term of this patent is extended or adjusted under 35 U.S.C. 154(b) by 300 days.

(21) Appl. No.: 10/834,565

(22) Filed: Apr. 28, 2004

(65) Prior Publication Data

US 2004/0222264 A1 Nov. 11, 2004

Related U.S. Application Data

(60) Provisional application No. 60/466,548, filed on Apr. 28, 2003.

(51) Int. Cl.
*B26F 3/02* (2006.01)

(52) U.S. Cl. ..... 225/39; 206/407

(58) Field of Classification Search ..... 83/856; 225/52, 39; 206/407
See application file for complete search history.

(56) References Cited

U.S. PATENT DOCUMENTS 2,017,176 A * 10/1935 Andrews ..... 229/131.1
2,176,822 A * 10/1939 Nordlund ..... 225/19
3,939,628 A * 2/1976 Schjeldahl ..... 53/397
4,619,104 A * 10/1986 Germunson ..... 53/459
4,958,733 A * 9/1990 Masuda ..... 206/409
5,080,270 A * 1/1992 Kai ..... 225/52
5,566,872 A * 10/1996 Dolan et al. ..... 225/41
5,890,351 A 4/1999 Shiotari
6,688,607 B2 * 2/2004 Casey et al. ..... 277/602
D495,544 S * 9/2004 Tan ..... D6/515
2006/0196909 A1 * 9/2006 Hadtke et al. ..... 225/39

OTHER PUBLICATIONS

Ruffies On The Go Trash Bags, photocopy of front and back of container, 25 bags—1 gallon, © 2002 Tyco Plastics LP.

* cited by examiner

*Primary Examiner*—Kenneth E. Peterson
(74) *Attorney, Agent, or Firm*—Beyer Weaver LLP

(57) ABSTRACT

A self-contained dispenser apparatus configured to dispense a continuous feed of plastic bag material wound in a coreless roll thereof. The dispenser apparatus includes a base portion defining an opening into a receiving bay thereof. A cover assembly is removably mountable to the base portion, and includes an end cover portion positioned over the opening to enclose the coreless roll therein. A dispensing slot extends through the end cover that enables one end of plastic bag material to continuously feed therethrough. The cover assembly further includes a cutting assembly positioned proximate the dispensing slot to enable severing of the plastic bag material.

8 Claims, 5 Drawing Sheets

DISPENSER APPARATUS AND METHOD FOR A CONTINUOUS ROLL OF PLASTIC BAG MATERIAL

RELATED APPLICATION DATA

This application claims priority under 35 U.S.C. §119 to U.S. Provisional Application Ser. No. 60/466,548, filed Apr. 28, 2003, and entitled DISPENSER APPARATUS FOR A CONTINUOUS ROLL OF BAG MATERIAL, the entirety of which is incorporated herein by reference in its entirety for all purposes.

TECHNICAL FIELD

The present invention relates to containers and dispensers and, more particularly, relates to containers and dispensers for rolls of continuous rope of plastic bag material.

BACKGROUND ART

The use of common disposable plastic bags have unlimited use for both household, commercial and industrial applications. Plastic bags, of course, may be found in a variety of sizes and shapes, some of which are more useful than others. Common uses, for instance, include the containment of trash and other refuse, especially when moisture is involved. On particular application for parents and/or pet owners is for the containment of diaper and pet feces.

In whatever application, the storage of these plastic bags, such as common grocery bags, is generally in a disorganized manner. Many individuals retain at least a portion of these grocery bags for secondary household uses when ever needed. They are often thrown into a drawer or other container dedicated for such bags. Others store these plastic bags randomly in the another container, causing an unsitely and disorganized mess of plastic bags. Still others individually fold the bags neatly for storage which in itself is a rather time consuming task.

Accordingly, there is a need for containers and dispensers that provide organized containment and dispensing of universal plastic bags for household, commercial and industrial.

DISCLOSURE OF INVENTION

The present invention provides a self-contained dispenser apparatus configured to dispense a continuous feed of plastic bag material wound in a coreless roll thereof. The dispenser apparatus includes a base portion defining an opening into a receiving bay thereof. The receiving bay is formed and dimensioned for receipt of the coreless roll therein. A cover assembly is removably mountable to the base portion, and includes an end cover portion positioned over the opening to enclose the coreless roll therein. A dispensing slot extends through the end cover that enables one end of plastic bag material to continuously feed therethrough. The cover assembly further includes a cutting assembly positioned proximate the dispensing slot to enable severing of the plastic bag material, and a lid portion movable between an open position and a closed position. In the opened position, access is provided to the one end of the plastic bag material and to the cutting assembly. In the closed position, the one end of the plastic bag material and cutting assembly are enclosed within the lid portion.

In one specific embodiment, the cutting assembly includes a support plate upstanding from the end cover, and in which a cutting blade is embedded therein. A surrounding wall upstands from the end cover and surrounding the dispensing port. One end of the surround wall supports one side of the support plate, while the other end of the surround wall supports an opposite side of the support plate.

In another specific configuration, the cutting assembly includes a cutting slot formed in the support plate. The cutting slot is angled relative a horizontal plane in the range of about 30° to about 60°, and more preferably about 45°.

In still another configuration, a clip assembly is included having a clip device that cooperates with the base portion for clipping of the dispensing apparatus. The clip assembly includes a sleeve removably mounted to a skirt portion of the cover assembly, and the clip device extending downwardly from the sleeve.

In yet another embodiment, the end cover include a plurality of flexible leaflet portions arranged in opposed relationship to form an X-shaped dispensing slot. These flexible leaflets cooperate to retain the plastic bag material therebetween.

In another aspect of the present invention, a self-contained dispenser apparatus is provided for dispensing a continuous feed of plastic bag material. The dispenser apparatus includes a coreless roll of plastic bag material having one end providing a continuous feed thereof. The plastic bag material is bunched in a "rope" form and wound into the coreless roll such that upon unwinding of the one end of the plastic bag material, the one end is substantially maintained in the "rope" form until unraveled. The dispenser apparatus further includes a base portion defining an opening into a receiving bay thereof, the receiving bay of which is formed and dimensioned for receipt of the coreless roll therein. A cover assembly is removably mountable to the base portion, and includes an end cover portion positioned over the opening to enclose the coreless roll therein. The end cover portion includes a dispensing slot that enables one end of plastic bag material to continuously feed therethrough. A cutting assembly is positioned proximate the dispensing slot to enable severing of the "rope" of plastic bag material.

BRIEF DESCRIPTION OF THE DRAWINGS

The valve of the present invention has other objects and features of advantage which will be more readily apparent from the following description of the best mode of carrying out the invention and the appended claims, when taken in conjunction with the accompanying drawing, in which:

DESCRIPTION OF THE INVENTION

Figure 2:
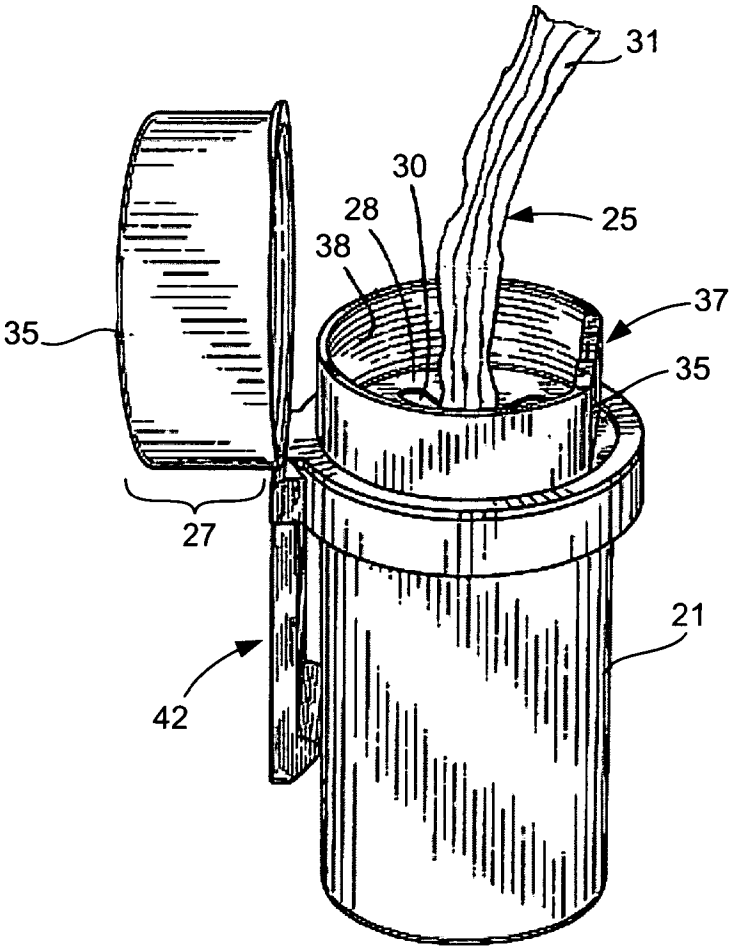
FIG. 2 is a top perspective view of the dispenser of FIG. 1, in an opened position, illustrating a continuous roll of plastic bag extended therefrom.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 1:
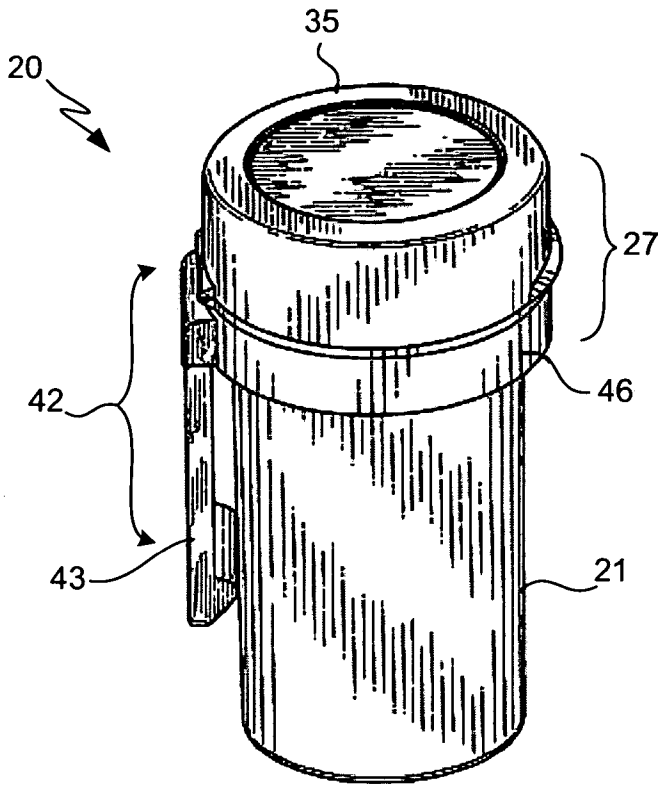
FIG. 1 is a top perspective view of a dispenser for a continuous roll of plastic bags constructed in accordance with the present invention.
Figure 6:
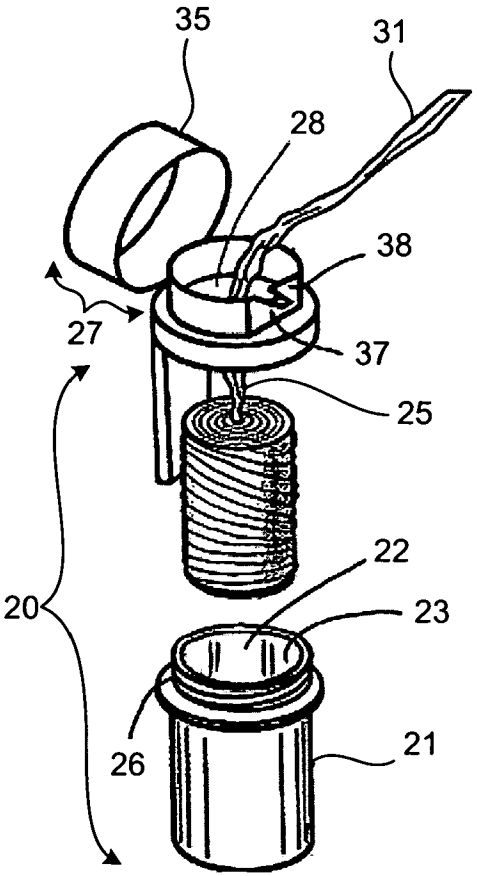
FIG. 6 is an exploded, reduced top perspective view of the dispenser of FIG. 1, showing assembly thereof.

Referring now to FIGS. 1, 2 and 6, a self-contained dispenser apparatus, generally designated 20, is provided that is configured to dispense a continuous feed of plastic bag material 25 wound in a coreless roll 24 thereof. The dispenser apparatus 20 includes a base portion 21 defining an opening 22 into a receiving bay 23 thereof. The receiving bay 23 being formed and dimensioned for receipt of the coreless roll 24 therein. A cover assembly, generally designated 27, is removably mountable to the base portion 21, and includes an end cover 28 positioned over the opening 22 to enclose the coreless roll 24 therein. The end cover 28 includes a dispensing slot 30 that enables one end of plastic bag material to continuously feed therethrough. A cutting assembly, generally designated 37, is positioned proximate the dispensing slot 30 to enable severing of the plastic bag material 25. The cover assembly 27 includes a lid portion 35 movable between an open position (FIGS. 2-5) and a closed position (FIG. 1). In the open position, the plastic bag material and the cutting assembly can be accessed, while in the closed position, the plastic bag material and cutting assembly are enclosed within the lid portion.

Accordingly, a self contained dispenser device is provided for a continuous roll of plastic bag material that includes an embedded cutting blade. Due to the compact design of the roll of plastic bag material, a relatively large quantity of bag material can be contained in a small footprint, while at the same time organizing the material output and storage. Further, the cap portion closes over both the bag dispenser opening and the blade, when in non-use, for safety purposes. Hence a safe, portable plastic bag dispenser is provided that is suitable for almost any universal use.

Figure 9B:
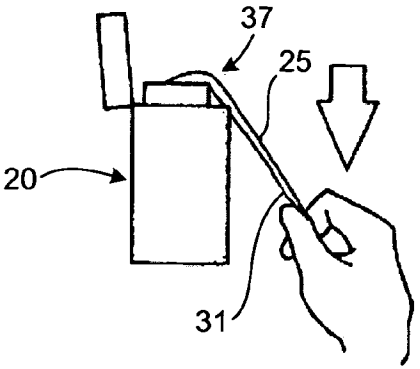
FIGS. 9A-9E is a sequence of operation showing application of the dispenser of FIG. 1.
Figure 9A:
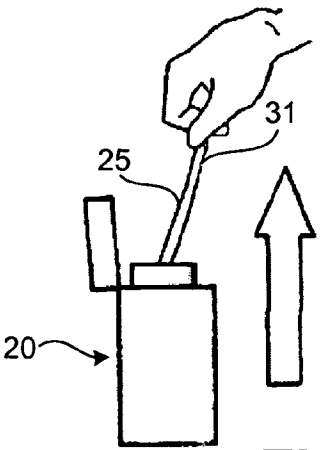
Figure 9C:
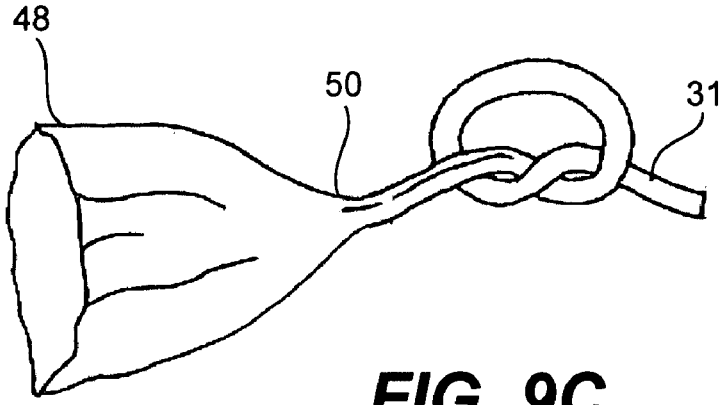
Figure 9D:
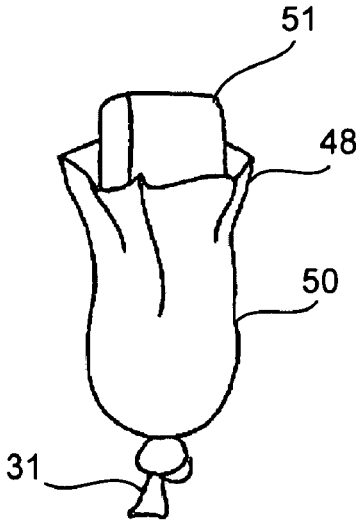

Incidentally, as shown in FIGS. 9C and 9D, the plastic material 25 is defined as a cylindrical shell of plastic bag material having open ends 31, 48. Once knots are formed at the opposed ends thereof, a bag is formed to contain an object.

Referring back to FIGS. 1-6, the container 20 includes cylindrical base portion 21 having an opening 22 into a receiving bay 23 thereof. The receiving bay 23 is configured for receipt of the continuous coreless roll 24 of bag material 25 therein. The upper portion of the cylindrical base portion 21, defining the opening 22, provides a male threaded portion 26 to threadably mount the cover assembly 27.

The cover assembly 27 is adapted to fit over the hollow opening 22 to enclose the receiving bay 23 with the roll 24 of bag material 25 therein. A bottom side of the cover assembly 27 includes a female threaded portion 29 (FIG. 7) adapted to threadably receive and mate with the male threaded portion 26 of the base portion 21. Hence, as shown in FIGS. 2 and 6, the cover assembly 27 is fitted to the male threaded portion 26, and then conventionally thread mounted to the cover assembly 27. It will appreciated, however, that other conventional mounting techniques and structure (such as snap fit, screw mount, etc.) between the cover assembly 27 and the cylindrical base portion 21 may be provided without departing from the true spirit and nature of the present invention.

The cover assembly 27 includes an end cover 28 extending over the base opening 22 to enclose the roll 24 of bag material 25 when the cover assembly is mounted to the base. A dispensing slot 30, extending through the end cover, enables the one end 31 of the continuous roll of bag material to extend through for access. As best viewed in FIGS. 2 and 5, the dispensing slot 30 is X-shaped, and positioned substantially central the end cover 28 atop the cylindrical base portion 21.

The end cover 28 includes a plurality of flexible leaflets 32 that collectively define the X-shaped dispensing slot 30. Each leaflet terminates at a corner portion 33, which are in opposed relationship to one another to form the center of the X-shaped dispensing slot 30 The spacing between the opposed corner portions 33 are less than the diameter of the rope-shaped one end 31 of the bag material 25. This assures sufficient gripping of the rope of bag material as it is dispensed from the container so that it cannot be dispensed unless pulled, while at the same time permitting removal from the container without high gripping forces.

The cover assembly 27 includes a lid portion 35 hingeably mounted thereto that is movable from a closed position (FIG. 1) to an opened position (FIGS. 2-5). The to provide access to one end 31 of the bag material 25. The lid portion 35 cooperates with the cover assembly 27 to snap or friction fit shut to the closed position.

Upstanding from the end cover 28 is a support plate 36 that supports a cutting assembly 37. The support plate 36 extends across a front portion of the cover assembly 27, opposite the hinge mount of the lid portion 35 thereof. A circular surrounding wall 38 surrounds the X-shaped dispensing slot 30, and connects to the ends of the support plate 36, providing stability to the cutting assembly 37.

Figure 4:
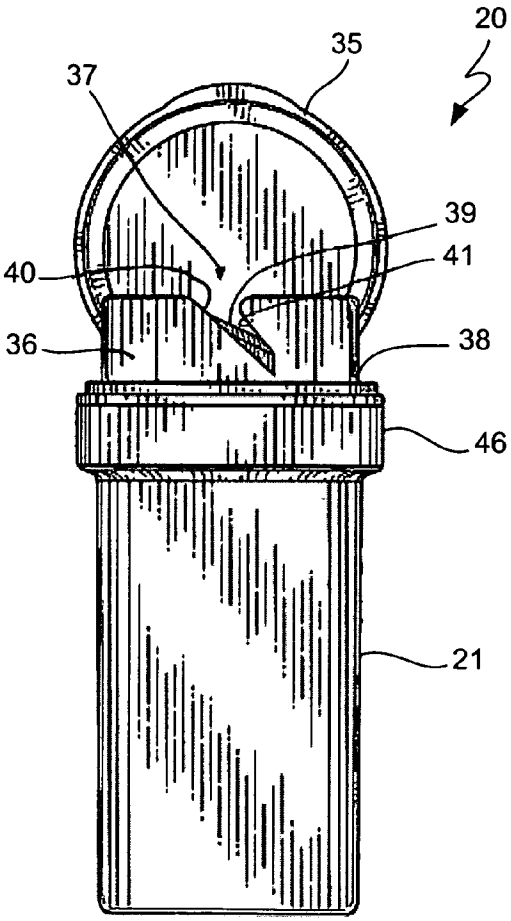
FIG. 4 is a front elevation view of the dispenser of FIG. 3, and illustrating a cutting assembly.
Figure 3:
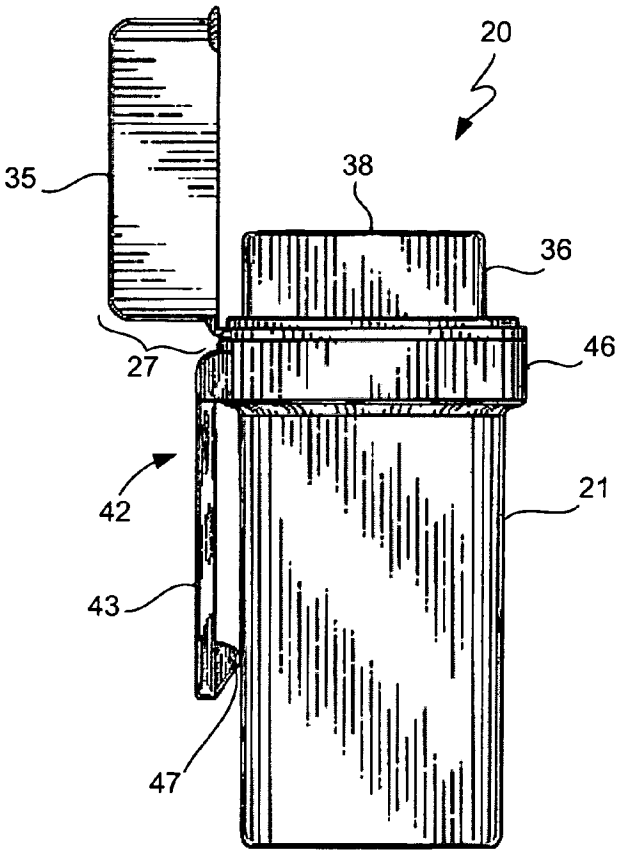
FIG. 3 is a side elevation view of the dispenser of FIG. 1, with the lid portion in the opened position.
Figure 5:
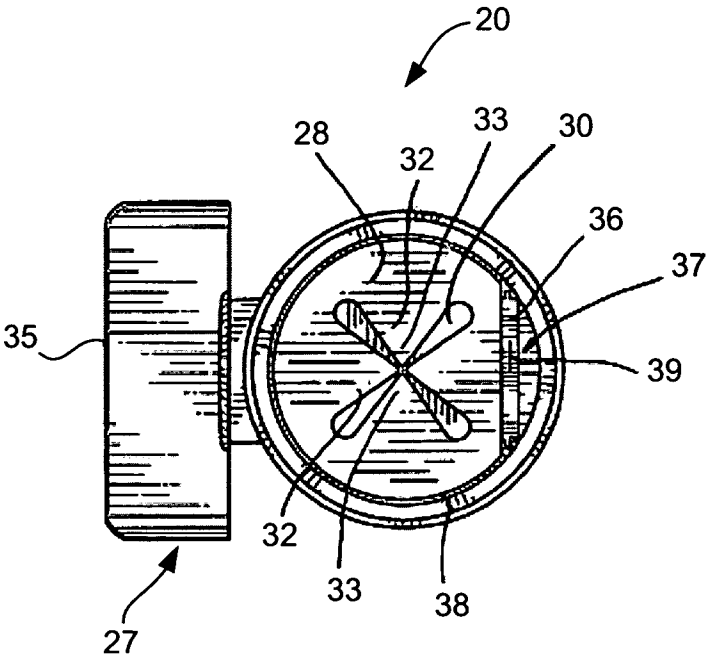
FIG. 5 is a top plan view of the dispenser of FIG. 3, and illustrating the dispensing slot.
Figure 7:
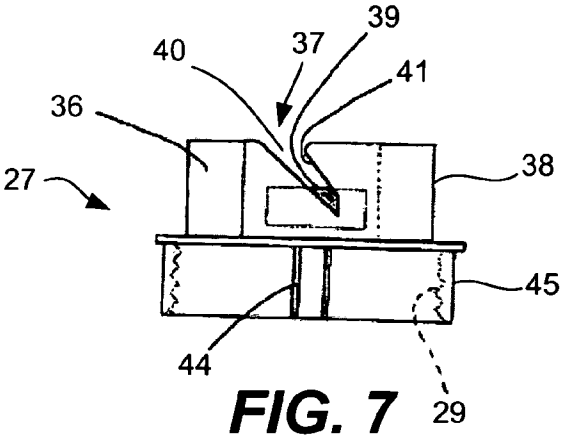
FIG. 7 is an alternative embodiment front elevation view of a cover assembly of the dispenser of FIG. 1.

As best viewed in FIGS. 4, 5 and 7, the cover assembly 27 includes a cutting assembly 37 that includes a cutting blade 39 embedded in the support plate 36, and contained within the lid portion 35, when in the closed position. This assures a significant amount of safety from inadvertent contact. The cutting assembly includes a cutting slot 40 defined in the support plate, and slanted at an angle from the vertical. In the preferred form, the slant of the slot from the vertical is in the range of about 30° to about 60°, and most preferably about 45°. The slot is angled downwardly to promote severing of the rope of by pulling downwardly against the cutting blade 39, as shown in FIG. 9B. Further, the width of the slot is sufficiently small so as to prevent insertion of adult fingers, while being sufficiently large to permit the passage of the rope of bag material therethrough.

Contained within the cutting slot 40 is the cutting blade 39 having an upwardly facing edge extending across the slot. In one embodiment, as shown in FIG. 4, the blade is sloped downwardly in the same direction as that of the slot, although not as steep. This assures that the upper wall 41 defining the cutting slot 40 converges toward the cutting edge to facilitate cutting as the rope of bag material is pulled downwardly. In another embodiment, as shown in FIG. 7, the cutting edge of the cutting blade 39 is positioned substantially horizontal, widening the cutting angle between the upper wall 41 of the cutting slot 40 and the cutting edge.

As best illustrated in FIG. 1, when the lid portion 35 of the cover assembly 27 is in the closed position, both the dispensing slot 30 and the cutting assembly 37 are enclosed within. This assures safety and cleanliness for these components within the lid portion.

Figure 8:
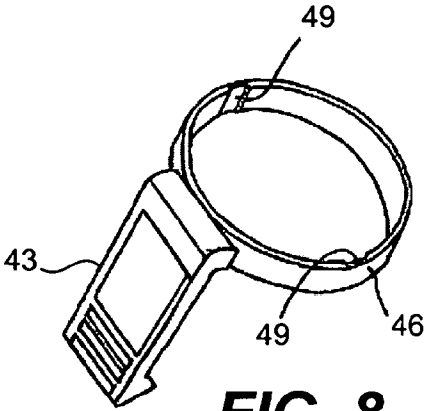
FIG. 8 is a top perspective view of a clip device of the dispenser of FIG. 1.

A clip assembly 42 including a clip device 43 enables clipping of the container 20 to a variety of objects. Preferably, the clip assembly 42 is removably mounted to a skirt portion 45 of the cover assembly 27 that defines the female threaded portion 29, as shown in FIGS. 7 and 8. The clip assembly includes a sleeve portion 46 which is slideably nested around the skirt portion 45. To prevent rotation about the skirt portion 45, one of the skirt portion and the interior of the sleeve portion 46 includes a key 44 and a mating slot 49 for keyed receipt therein.

Downwardly depending from, and cantilever mounted to, the sleeve portion 46 is the clip device 43. The clip device is sufficiently resilient to maintain an thin object between the clip device and the exterior of the base portion 21. To facilitate clipping, the clip device 43 includes a gripping nub 47 extending toward the base portion 21.

Briefly, the continuous roll 24 of bag material 25 is essentially a continuous cylindrical-shell of thin plastic bag material to be knotted at both ends when being used to close off either end. Incidentally, the plastic bag material 25, once severed, is a continuous hollow cylindrical shell material containing two open ends 31, 48. Logic would thus dictate that the bag material would be laid-out relatively flat, and perhaps folded over until a height is achieved that enables receipt in the receiving bay 23. Subsequently, the folded bag material would then be rolled to form the continuous roll 24 of bag material 25, similar to how may other forms of plastic bags (albeit not continuous cylindrical shells) are stored.

In accordance with the present invention, however, the continuous roll 24 of bag material 25 is rolled in a novel coreless manner that facilitates severing of the "rope" during the cutting procedure. As shown in FIG. 6, rather than expanding the bag material, as mentioned above, it is bunched in a "rope" pattern, and rolled in this manner similar to a roll of string as opposed to a roll of plastic bags, except that it is coreless. This provides two advantages during dispensing of the bag material which will be described below.

Briefly, in operation, the one end 31 of the bag material 25 is manually pulled through the X-shaped dispensing slot 30 (FIGS. 2, 6 and 9A). In the preferred form, the "rope" of bag material is dispensed from the center of the continuous roll of bag material rather than the circumference or exterior of the roll. In a first advantage of the "rope" winding configuration, as mentioned, it is easier to withdraw and unwind the "rope" from the roll. Since the material is plastic, there is a natural static tendency to stick together with the adjacent layers. By bunching the material together into a "rope" or strand, there is less surface area touching the roll, and thus less static and frictional drag during the unwinding dispensing.

Once the desired length of plastic bag material 25 is attained, the rope of bag is pulled downwardly (FIG. 9B) and into the cutting slot 40 (FIGS. 4 and 6). Thus, in a second advantage of the bunched "rope" configuration, the dispensed bag material is already gathered together. This facilitates the cutting operation since it is already bunched together which fits more easily into the cutting slot 40. Further, the "rope" material is in a denser configuration which is easier to sever. Hence, by manually pulling the "rope" of bag material downwardly, the distended "rope" 50 of bag material is severed as it is wedged into cutting assembly 37 between the cutting blade 39 and upper wall 41.

Figure 9E:
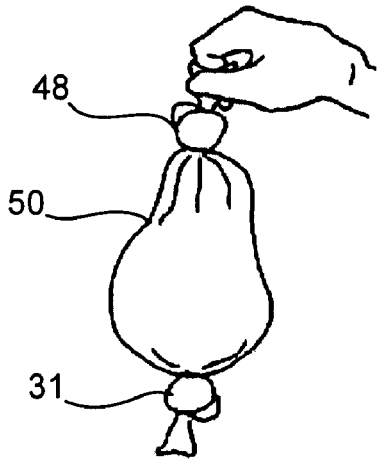

Accordingly, the one end 31 of the cut plastic bag material "rope" 50 is knotted, as in shown FIG. 9C, to seal that end. The opposite open end 48 may then be utilized to place a targeted object 51 into the hollow of the bag material (FIGS. 9D). Subsequently, the opposite open end 48 can be knotted (FIG. 9E) to close off the bag material and contain the targeted object 51 therein.

While this invention is described in terms of a specific embodiment, there are alterations, permutations, and equivalents which fall within the scope of this invention. It should also be noted that there are many alternative ways of implementing the present invention. It is therefore intended that the invention not be limited by the accompanying disclosure, but be interpreted as including all such alterations, permutations, and equivalents as fall within the true spirit and scope of the present invention.

What is claimed is:

1. A self-contained plastic bag dispenser system for dispensing a continuous feed plastic bag material, said dispenser system comprising:

a coreless roll of a thin, tubular plastic bag material sufficiently sized diametrically for common household use as an all-purpose plastic bag, and having one end providing a continuous feed thereof, said plastic bag material being bunched into a relatively untwisted "rope" and wound into said coreless roll in a bunched, relatively untwisted flat "rope" form, such that upon unwinding of the one end of the plastic bag material from a center portion of the coreless roll, the one end is substantially maintained in said "rope" form until unbunched;

a substantially cylindrical base portion defining an opening into a substantially cylindrical receiving bay thereof, said receiving bay being formed and dimensioned for axial receipt of said coreless roll therein; and a cover assembly removably mountable to the base portion in a manner extending over the opening into the receiving bay, said cover assembly being separable from the base portion for unimpeded access to the receiving bay to enable replacement of the coreless roll therein, said cover assembly, including:

substantially planar end cover portion having a peripheral edge and being positioned over said opening when mounted to the base portion to enclose the coreless roll therein, said end cover portion including a central dispensing slot that enables one end of plastic bag material to continuously feed therethrough from said center portion of the coreless roll, a support assembly including a substantially planar support plate upstanding from said end cover portion, and a substantially circular support wall upstanding from said end cover portion and having one end supporting one side of said support plate and the other end of said surround wall supporting an opposite side of said support plate, said support plate and said support wall substantially encircling the dispensing slot, and being inset radially from said peripheral edge of the end cover portion with respect to a longitudinal axis of the cover assembly, a cutting assembly supported by the support plate and positioned proximate said dispensing slot to enable severing of the "rope" of plastic bag material, and a snap-fit lid portion hingeably mounted to the end cover portion between an open position, enabling access to the one end of said plastic bag material and the cutting assembly, and a closed position, fully enclosing said support assembly and said cutting assembly within the lid portion.

2. The plastic bag dispenser system according to claim 1, wherein said cutting assembly includes a cutting blade embedded in said support plate.

3. The plastic bag dispenser system according to claim 2, wherein said cutting assembly further includes a cutting slot in said support plate, said cutting slot being formed and dimensioned for receipt of the "rope" of plastic bag material therein, and said cutting blade extending across said cutting slot.

4. The plastic bag dispenser system according to claim 3, wherein said cutting slot is angled relative a horizontal plane in the range of about 30° to about 60°.

5. The plastic bag dispenser system according to claim 4, wherein an edge of said cutting blade is contained substantially in a horizontal plane.

6. The dispenser apparatus according to claim 1, further including:

a clip assembly having a clip device that cooperates with the base portion for clipping of the dispensing apparatus.

7. The dispenser apparatus according to claim 6, wherein said clip assembly includes a sleeve removably mounted to a skirt portion of said cover assembly, and said clip device extending downwardly from said sleeve.

8. The plastic bag dispenser system according to claim 1, wherein said cover assembly is threadably mounted to the base portion.

* * * * *